United States Patent [19]

Gillet

[11] Patent Number: 4,769,961

[45] Date of Patent: Sep. 13, 1988

[54] BUILDING BLOCK AND STRUCTURE MADE THEREFROM

[75] Inventor: Joseph Gillet, Rochefort, Belgium

[73] Assignee: Hanota Holdings SA, Luxembourg, Luxembourg

[21] Appl. No.: 9,457

[22] Filed: Feb. 2, 1987

[30] Foreign Application Priority Data

Feb. 7, 1986 [BE] Belgium ..... 0/216244

[51] Int. Cl.[4] ..... E04B 1/32

[52] U.S. Cl. ..... 52/245; 52/436; 52/437; 52/438; 52/595

[58] Field of Search ..... 52/589–595, 52/436–442, 286, 245–249; 138/157–162

[56] References Cited

U.S. PATENT DOCUMENTS

| | | | |
|---|---|---|---|
| 1,203,170 | 10/1916 | Baumgartl | 52/595 |
| 1,601,411 | 9/1926 | Parmley | 52/595 |
| 1,692,529 | 11/1928 | Zagorski | 138/162 |
| 2,088,238 | 7/1937 | Greenway | 52/436 |

FOREIGN PATENT DOCUMENTS

| | | | |
|---|---|---|---|
| 320918 | 12/1902 | France | 52/436 |
| 3411479 | 7/1985 | Fed. Rep. of Germany. | |
| 142311 | 9/1953 | Sweden | 52/595 |
| 172585 | 12/1921 | United Kingdom . | |
| 591067 | 8/1947 | United Kingdom | 52/286 |

*Primary Examiner*—James L. Ridgill, Jr.
*Attorney, Agent, or Firm*—Weiser & Stapler

[57] ABSTRACT

There is described a building block, notably shuttering blocks to be laid dry, having at the one end thereof a fork and at the other end thereof, adjacent the side edges thereof, recesses wherein the free fork ends from another block substantially of the same type, can enter, in which the depth of the one said recesses along the block length direction, is deeper than the corresponding depth of the other recess.

17 Claims, 1 Drawing Sheet

BUILDING BLOCK AND STRUCTURE MADE THEREFROM

This invention relates to a building block, notably shuttering blocks to be laid dry upon one another and in the extension of one another, and to be filled with a binder, such as concrete.

These are more particularly blocks having at the one end thereof a fork and at the other end thereof, adjacent to the side edges thereof, recesses wherein the free fork ends from another block substantially of the same type, can enter.

The invention has essentially for object a building block having said characteristics which allows erecting curvilinear or circular walls with varying curvature radiuses or diameters.

It is more particularly a building block allowing to build silos or cylinder-shaped towers.

For this purpose, in the building block according to the invention, the depth of the one said recesses along the block length direction, is deeper than the corresponding depth of the other recess.

Advantageously, that end where said recesses are provided has a side or similar members lying substantially in parallel relationship with the plane going through the fork free ends.

In a particularly advantageous embodiment of the invention, that side of the shallower recess the corresponding fork free end fits against, so slants as to form an acute angle with the fork bisecting plane.

In a preferred embodiment of the invention, at least one outer side wall of said block is of convex or concave shape.

In a particular embodiment of the invention, the one side wall is convex-shaped, the other one being concave-shaped, whereby the cross-sections through both side walls along a plane in parallel relationship with the block base are substantially identical.

The invention further pertains to a structure or building made by means of blocks as described hereinabove.

It is notably a structure which has for feature to comprise blocks laid along a substantially curved line and in the extension of one another, in such a way that the fork free ends from some particular block enter the corresponding recesses from the adjacent block, the deeper recess lying on that block side facing the center of curvature of said line.

Other details and features of the invention will stand out from the following description, given by way of non limitative example and with reference to the accompanying drawings, in which.

Figure 1:
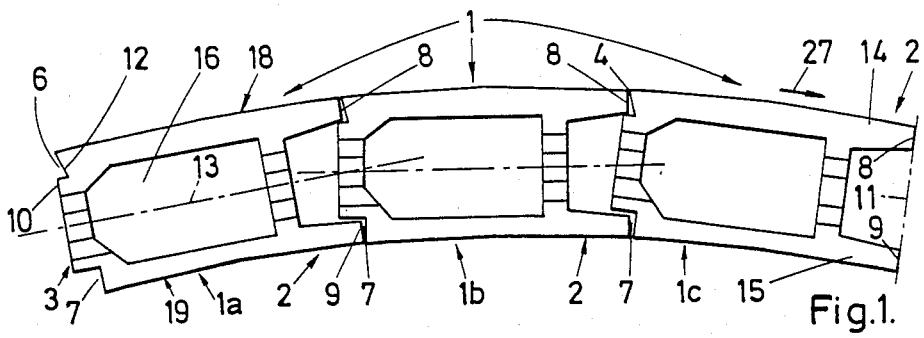
FIG. 1 is a plan view of three blocks in a particular embodiment of the invention, as laid in the extension of one another along the minimum radius of curvature.

The invention relates to a building block which is preferably made from concrete or similar, for making structures or buildings part of the walls thereof at least is curved.

These blocks are more particularly hollow shuttering blocks which are to be laid dry and wherein a binder is to be cast, such as concrete, to join the assembled blocks together.

As shown in the figures, it is a block 1 having at the one end thereof, a fork 2 and on the opposite end 3 thereof, actually comprising the block back, adjacent the side edges 4 and 5 of said end 3, respective recesses 6 and 7 are provided, wherein the free ends 8 and 9 from the fork 2 on another block substantially of the same type, can enter.

Figure 2:
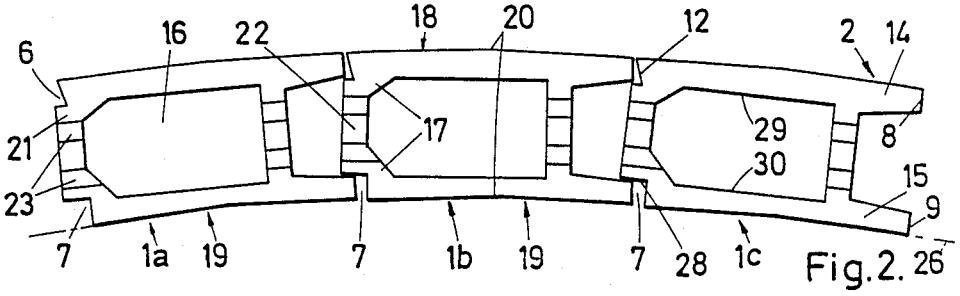
FIG. 2 shows the same blocks but as laid along a longer radius of curvature.
Figure 3:
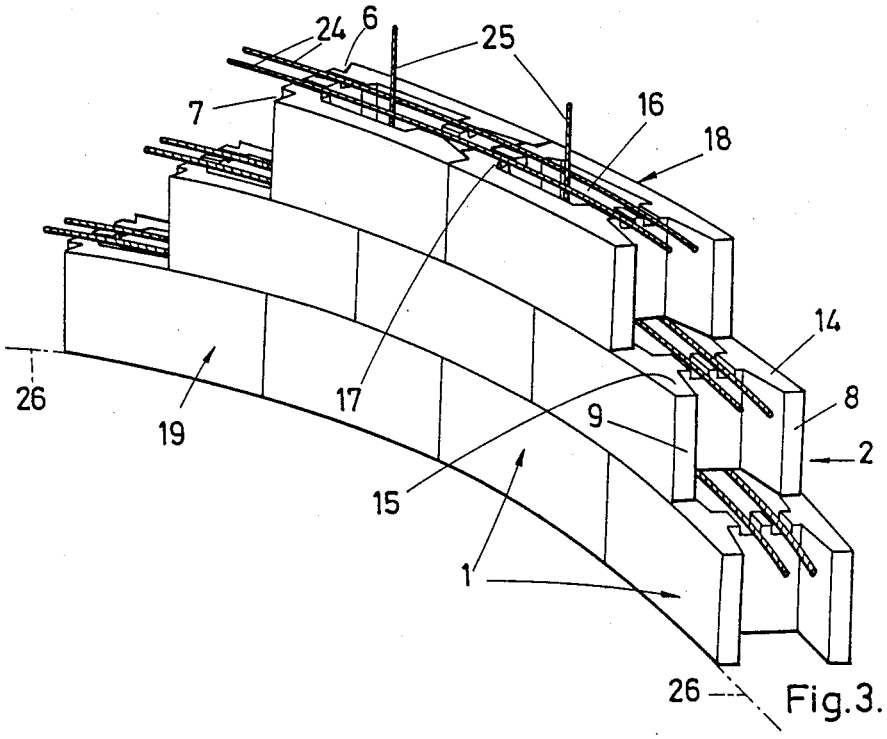
FIG. 3 is a perspective view of part of a structure erected by means of blocks from the same type as shown in FIGS. 1 and 2.

FIGS. 1 and 2 show in plan view, three identical blocks fitting together along a curved line.

Said block has for feature that the depth of the one recess 7, along the length direction of block 1, is deeper than the corresponding depth of the other recess 6.

The end or back 3 of block 1 has a surface 10 substantially in parallel relationship with that plane 11 going through the free ends 8 and 9 of fork 2.

This has the advantage of allowing the blocks ot be handled for packing with any type of packing clamp.

In the embodiment of the block according to the invention as shown in the figures, that surface 12 of the deeper recess 6 whereon the free end 8 of fork 2 can fit, so slants as to form an acute angle with the lengthwise bisecting plane 11 of said fork 2.

This comprises a means allowing to avoid forming too wide a joint between between the free end 8 of fork 2 from a block 1*a*, and the edge 4 of the corresponding recess 6 from adjacent block 1*b*, for example, and this substantially independently from the length of the radius of curvature of that structure being erected by means of said blocks.

Moreover, the legs 14 and 15 from fork 2 have substantially the same length. This notably makes it easier to make moulds for manufacturing said blocks.

As the blocks shown in the figures are shuttering blocks, such blocks each have a hollow cavity 16 which extends over the whole height of said block 1.

Said hollow cavity is in the shape of a rectangular parallelopiped those corners of which facing the block back 3 are provided with stiffenings 17.

To obtain a controlled and substantially uniform filling of the hollow cavities from blocks superimposed in the forme of a wall, and to avoid as far as possible that two cross-wise walls lie one above the other, the length of said fork 2 is advantageously different from the length of half the block 1.

As in the embodiment shown in the figures, the fork length is preferably shorter that half the block length and corresponds for example to one third the block length.

To improve somewhat the round shape of a wall formed by said blocks 1, at least the one outer side surface of said blocks is convex- or concave-like.

For instance, the outer side surface 18 opposite the opposite outer side surface 19 facing the center of the wall curvature, is convex-shaped.

The cross-sections through both said side surfaces 18 and 19 along a plane in parallel relationship with the block base are preferably substantially identical to make manufacturing the moulds easier.

Indeed inside the mould, the side partition between two blocks may simply be comprised of a folded metal sheet.

Such convex and concave shapes may thus also have a polygonal shape.

More particularly, in the embodiment as shown in the drawings, both outer side surfaces 18 and 19 have a cross-section along a plane in parallel relationship with the block base in the shape of a broken line comprised of two straight segments which cross substantially in the middle of the sides thereof, as shown with reference numeral 20.

In another embodiment of the invention, said sides might have a curved shape.

Actually that location 20 where both straight segments cross is not comprised in practice of a point, but rather of an arc which is thus obtained by means of a folded metal sheet which forms the partition between two blocks inside one and the same mould, as already stated hereinabove.

As it appears clearly from the figures, in the embodiment as shown, the shallower recess 6 lies on the side of the convex outer side surface 18.

To allow fitting correctly the reinforcement rods, when such appear necessary, notches 23 are provided in the top edge of cross-wise walls 21 and 22. Said notches 23 are intended to receive the horizontal reinforcement rods 24.

Such notches are deep enough to allow enough coating by the binder cast in the block hollow cavities 16.

On the other hand, vertical reinforcement rods 25 may thus be retained in position by securing same for example at regular intervals to those horizontal rods secured inside said notches 23.

The structure being erected according to the invention by means of said blocks, comprises laying said blocks along a curved line 26, in the extension of one another in such a way that the free ends 8 and 9 of the fork 2 from a block 1*a* fit into the recesses 6 and 7 from the adjacent block 1*b*.

The deeper recess 7 lies on the side of that side surface 19 facing the center of curvature, not shown, of said line 26.

Advantageously, the forks from the various blocks, for example 1*a*, 1*b* and 1*c*, face in the same direction as shown by arrow 27.

The fitting together of the forks 2 and the corresponding recesses 6 and 7 from an adjacent block is adjustable as a function of the desired radius of curvature for the line 26.

Care should however be taken to insure the sealing between two succeeding blocks when filling same with a binder, such as concrete.

In a particular embodiment of the invention, the free end 8 from leg 14 of fork 2 lying on the side of that side surface 18 opposite to the surface facing the center of curvature of said line 26, fits down to the bottom inside recess 6, while the free end 9 of the other leg 15 fits into recess 7 to a depth which is a function of the desired length for the radius of curvature of said line 26.

Thus FIG. 1 shows a structure wherein both free fork ends 8 and 9 are fitted down to the bottom into the corresponding recesses 6 and 7 from the adjacent block, in such a way that the radius of curvature has a minimum length.

On the other hand, FIG. 2 shows the same blocks as arranged along a line 26 with a longer radius of curvature, in such a way that the end 8 of leg 14 of fork 2 only is fitted down to the bottom in the corresponding recess 6 thereof, while the free end 9 of the other leg 15 lies some distance away from the bottom of the recess 7 thereof.

A narrow slit 28 is thus provided on the side of the block side surfaces 18 which can be filled when required, with mortar, for example when finishing the curved wall obtained by means of said blocks.

Generally, contrary to what is the case for the outer side surfaces 18 and 19, the inner surfaces 29 and 30 bounding the hollow cavity 16 in the blocks 1 are completely flat and in parallel relationship with one another, which also makes manufacturing the moulds easier and has of course no drawback when laying the blocks.

To the contrary, said straight sides 29 and 30 make gauging the blocks easier, which may for example comprise laying down either small dry cement heaps, or dry cement trails on the top edges of those block side walls bounded on the one hand by the sides 18 and 29, and on the other hand by the sides 19 and 30 from the blocks when said blocks come out of the press and are still moist. Said cement is then flattened down to the gauged block height.

This is actually a gauging method which is known per se and has been the object of several patent applications in the name of the Applicant.

It must be understood that the invention is in no way limited to the above embodiments and that many changes might be brought therein without departing from the scope of the invention as defined by the appended claims.

For instance, the back 10 of said blocks might be comprised of ribs, rather than a flat substantially continuous projection in parallel relationship with that plane 11 passing through the ends 8 and 9 of fork 2.

On the other hand, when required, for example for erecting structures with a relatively small diameter, it might prove useful to use blocks 1 the fork 2 of which has a leg 15 with a length which is shorter than the other leg 14 of the same block.

It is further possible according to the invention, to use U-shaped blocks, for example in combination or not with blocks as described above and shown in the figures.

What is claimed is:

1. A building block having a fork with free ends at a first end thereof, and a pair of recesses at a second end thereof for receiving the free ends of the fork of a second building block and positioned at opposing edges of said second end, adjacent to side edges of said building block, wherein said second end is a surface extending between said recesses and substantially parallel to a plane passing through the free ends of said fork, wherein one of said recesses is deeper in a longitudinal direction than the other of said recesses, and wherein said other recess has a surface for receiving a free end of the fork of said second building block which is slanted to form an acute angle with said second end surface and the plane passing through the free ends of said fork.

2. The building block of claim 1 wherein said second end is a planer surface extending between said recesses.

3. The building block of claim 1 wherein said building block is a shuttering block to be laid dry upon other of said building blocks and in longitudinal extension of one another and filled with a binder to erect curved wall portions with varying curvatures.

4. The building block of claim 1 wherein the free ends of the fork have substantially the same length.

5. The building block of claim 1 which further comprises a notch in a top edge thereof for receiving a reinforcement rod therein.

6. A structure constructed from a plurality of building blocks as defined in claim 1 and comprising blocks laid along a line having curved portions and in extension of one another, so that the free ends of the fork of one of said blocks enters the corresponding recesses of another of said blocks with the deeper of said recesses lying on the side edge of the block which faces the center of curvature of the curved portions of said line.

7. The structure of claim 6 wherein one leg of the fork lying on the side of the block opposite to the center of curvature of the curved portions of said line fits substantially to the bottom of the corresponding recess of the adjacent block, and so that the other leg of the fork fits in the other recess to a distance which varies according to the radius of curvature of the curved portions of said line.

8. The building block of claim 1 wherein the length of the fork is different from one-half of the length of the block.

9. The building block of claim 8 wherein the length of the fork is less than one-half of the length of the block.

10. The building block of claim 8 wherein the length of the fork is about one-third of the length of the block.

11. The building block of claim 1 wherein at least one of the side edges of the block is convex or concave.

12. The building block of claim 11 wherein the side edge adjacent to the shallower recess is convex.

13. The building block of claim 11 wherein one of the side edges is convex and the other of the side edges is concave so that transverse cross-sections through said block are substantially identical along the length of the block.

14. The building block of claim 11 wherein said side edge forms the outer surface of the block.

15. The building block of claim 11 wherein said side edge has a polygonal shape.

16. The building block of claim 15 wherein said side edge is comprised of two straight segments which meet substantially in the middle of said side edge to define an obtuse angle therebetween.

17. The building block of claim 16 wherein said angle is greater than 170 degrees.

* * * * *